US008528310B2

(12) United States Patent
Ganahl et al.

(10) Patent No.: US 8,528,310 B2
(45) Date of Patent: Sep. 10, 2013

(54) SYSTEMS AND METHODS OF TWISTING AND HEAT-SETTING YARN, AND APPARATUS FOR TWISTING YARN AND HEAT-SETTING YARN

(75) Inventors: Peter Ganahl, Ringgold, GA (US); Ronnie Rittenhouse, Calhoun, GA (US)

(73) Assignee: Invista North America S.ár.l., Wilmington, DE (US)

( * ) Notice: Subject to any disclaimer, the term of this patent is extended or adjusted under 35 U.S.C. 154(b) by 121 days.

(21) Appl. No.: 13/056,766

(22) PCT Filed: Jul. 16, 2009

(86) PCT No.: PCT/US2009/050778

§ 371 (c)(1), (2), (4) Date: Mar. 16, 2011

(87) PCT Pub. No.: WO2010/014411

PCT Pub. Date: Feb. 4, 2010

(65) Prior Publication Data

US 2011/0154798 A1 Jun. 30, 2011

Related U.S. Application Data

(60) Provisional application No. 61/084,710, filed on Jul. 30, 2008, provisional application No. 61/085,148, filed on Jul. 31, 2008.

(51) Int. Cl.
*D01H 13/28* (2006.01)

(52) U.S. Cl.
USPC ..... 57/282

(58) Field of Classification Search
USPC ..... 57/282, 58.49–58.55
See application file for complete search history.

(56) References Cited

U.S. PATENT DOCUMENTS

| | | | | |
|---|---|---|---|---|
| 3,643,412 | A | 2/1972 | Maeda et al. | |
| 3,721,082 | A * | 3/1973 | Munzner | 57/282 |
| 3,812,664 | A | 5/1974 | Schippers | |
| 3,991,548 | A | 11/1976 | Toronyi et al. | |
| 5,154,044 | A | 10/1992 | Payen | |
| 5,267,430 | A | 12/1993 | Payen | |
| 6,089,009 | A * | 7/2000 | Hand et al. | 57/282 |

(Continued)

FOREIGN PATENT DOCUMENTS

| | | |
|---|---|---|
| EP | 0581439 | 2/1994 |
| EP | 0899366 | 3/1999 |
| JP | 2003286618 | 10/2003 |

OTHER PUBLICATIONS

Product Data Sheet, Jan. 2006: "M3 Heatset Process Controller", BMB Enterprises, Inc., Resaca, GA 30735.

(Continued)

*Primary Examiner* — Shaun R Hurley
(74) *Attorney, Agent, or Firm* — Christina W. Geerlof

(57) ABSTRACT

Included are close-couple twisting and heat-setting apparatus, methods of twisting two or more yarns and heat-setting twisted yarn. The apparatus and methods described permit operation at twisting speeds of about 10,000 to 100,000 rpm. In the event that yarn twisting is interrupted, and accumulating system is also included to prevent interruption of heat-setting the twisted yarn. The apparatus and methods are useful in the accelerated production of yarns suitable for soft floor coverings.

16 Claims, 2 Drawing Sheets

(56) References Cited

U.S. PATENT DOCUMENTS

| | | | | |
|---|---|---|---|---|
| 6,345,491 | B1 * | 2/2002 | Moran et al. | 57/333 |
| 6,880,212 | B2 | 4/2005 | Bakker et al. | |
| 2007/0095043 | A1 * | 5/2007 | Puaux | 57/282 |
| 2007/0137166 | A1 * | 6/2007 | Carter | 57/282 |

OTHER PUBLICATIONS

Product Data Sheet, Jan. 2006: "Operator Station for Win-Tex M3 Heatset Controller", BMB Enterprises, Inc., Resaca, GA 30735.

Promotional brochure: "Belmont Tack-Remover", Belmont Textile Machinery Co., Mount Holly, NC 28120.

Promotional brochure: "Belmont Twist-Tack", Belmont Textile Machinery Co., Mount Holly, NC 28120.

Promotional brochure: "Model AD-25 Auto-Doff Take-Up Winders, Model AC-50 Accumulators", Belmont Textile Machinery Co., Mount Holly, NC 28120.

Promotional brochure: "Models AD-30 and AD-35 Auto-Doff Take-Up Winders", Belmont Textile Machinery Co., Mount Holly, NC 28120.

Promotional brochure: "Model AD-40 Auto Doff Air-Entanglement Machines", Belmont Textile Machinery Co., Mount Holly, NC 28120.

Promotional brochure: "EW1000 Winder", Belmont Textile Machinery Co., Mount Holly, NC 28120.

Promotional brochure: "Rototwist", Belmont Textile Machinery Co., Mount Holly, NC 28120.

Promotional brochure: "MDS III Continuous Yarn Dyeing System", Saurer Inc., Charlotte, NC 28224.

Promotional brochure: "New BB2, 260mm Band Continuous Autoclave for Heat Setting/Dye Fixation", BMB Enterprises, Inc., Resaca, GA 30735.

Promotional brochure: "Externally Circulated BB2 Cooling Chambers", BMB Enterprises, Inc., Resaca, GA 30735.

Promotional brochure: "Refurbished Standard 200 mm Band 9, 12 or 18 Meter Tunnel", BMB Enterprises, Inc., Resaca, GA 30735.

Promotional brochure: "12 Meter Tunnel Extension", BMB Enterprises, Inc., Resaca, GA 30735.

Promotional brochure: "Luna Chrono X2", IRO Inc., Charlotte, NC 28273.

Promotional brochure: "CarpetTwister/CarpetCabler", Saurer Inc., Charlotte, NC 28224.

* cited by examiner

SYSTEMS AND METHODS OF TWISTING AND HEAT-SETTING YARN, AND APPARATUS FOR TWISTING YARN AND HEAT-SETTING YARN

CROSS-REFERENCE TO RELATED APPLICATION

The present application is a §371 application of PCT/US09/50778 filed Jul. 16, 2009 which application claims benefit of priority from Provisional Application No. 61/085,148 filed Jul. 31, 2008, now abandoned; and Provisional Application No. 61/084,710, filed Jul. 30, 2008, now abandoned.

BACKGROUND OF THE INVENTION

Two or more yarns are often twisted or "cabled" together to form plied yarns having various properties useful in the construction of soft floor coverings (i.e., tufted rugs and carpets). A standard cabling process involves physically rotating one yarn, fed from a creel, around a second yarn fed from a "bucket", both yarns being under carefully controlled tension, and then winding up the combined yarns in the form of a single, twisted (piled or cabled) yarn. Once the twisted yarn is produced, it is wound onto a tube and moved over to a heat-set apparatus. Then, the twisted yarn is directed into the heat-set apparatus to form a heat-set twisted yarn.

Machines to perform this operation are sold by various manufacturers, including: Oerlikon (Volkmann), Rieter (ICBT), China Textile Machinery Corporation (CTMC), Belmont, and the like. These machines typically include a creel to hold one of the feed yarns; a tension frame to control creel yarn tension; a tube to convey the creel yarn to a spindle; a "bucket", located above the spindle, containing the second feed yarn; tension devices; a bucket lid; and an extension arm (located no more than about 7 inches from the top of the bucket) to carry the creel yarn around the bucket yarn at specified speed (no more than 7200 rpm for over 99% of twisters currently in use and the other fraction of a percent (CTMC) claims 9000 rpm maximum).

Yarns are twisted together at frequencies ranging from about one turn to more than eight turns per inch, depending on yarn thickness and the intended effect. The higher the number of turns per inch the slower the operation becomes as the spindle carrying the creel yarn must complete a revolution for each "turn". For example, if two yarns are twisted at about 6000 rpm, at a frequency of two turns per inch, the winding speed of the product will be approximately 3000 inches (83 yards) per minute, neglecting other factors. Doubling turn frequency to four turns per inch would approximately halve the production rate (assuming the yarns are thin enough to permit the higher level of twist). Winding speed for a commercial twisting operation is usually about 50 yards per minute up to about 100 yards per minute achieving rotational speeds of 6000 up to claims of about 9000 rpm for lighter deniers.

Other carpet related yarn processes run much more quickly than cable-twisting does today. Spinning machines wind up at speeds in excess of 3000 yards per minute, while heat setting processes wind up at about 600 yards per minute.

Thus, twisting technology is one of the limitations of the carpet industry because although twisting is important to achieve the density and resilience required of tufted carpet, cabled yarns are processed relatively slowly compared to the preceding and subsequent processes. As a result of this industry "bottleneck", a relatively large investment in twisters and process inventory is required.

Using two distinct processes and apparatus, twisting apparatus and heat-set apparatus, is costly in terms of additional equipment, time, and square footage needed to operate.

SUMMARY OF THE INVENTION

Briefly described, embodiments of this disclosure include close-couple twisting and heat-setting apparatus, methods of twisting yarn and heat-setting twisted yarn, and the like. One exemplary close-couple twisting and heat-setting apparatus, among others, includes: a high-speed twisting system for producing a twisted yarn; a tension reducing system interfaced with the high-speed twisting system, wherein the twisted yarn is directed onto the tension reducing system from the high-speed twisting system to reduce the tension in the twisted yarn; an accumulating system interfaced with the tension reducing system, wherein the twisted yarn from the tension reducing system is accumulated; and a heat-setting system interfaced with the accumulating system, wherein the twisted yarn from the accumulating system is heat-set to form a heat set twisted yarn, wherein when the operation of the high-speed twisting system is stopped, the operation of the heat-setting system continues uninterrupted.

Another exemplary method of twisting yarn and heat-setting twisted yarn, among others, includes: twisting or cabling at least two yarns to form a twisted yarn using a high-speed twisting system; directing the twisted yarn to a tension reducing system that is interfaced with the high speed twisting system; reducing the tension in the twisted yarn using the tension reducing system; directing the twisted yarn from the tension reducing system to an accumulating system; accumulating the twisted yarn; directing the twisted yarn from the accumulating system to a heat-set system; and heat-setting the twisted yarn to form a heat-set twisted yarn.

One exemplary method of twisting yarn and heat-setting twisted yarn, among others, includes: twisting or cabling at least two yarns to form a twisted yarn; reducing the tension in the twisted yarn; accumulating the twisted yarn; and heat-setting the twisted yarn to form a heat set twisted yarn, wherein when twisting or cabling at least two yarn is stopped, the heat-setting of the twisted yarn continues uninterrupted.

One exemplary method of twisting yarn and heat-setting twisted yarn, among others, includes: means for spinning at least two yarns to form a twisted yarn; means for reducing the tension in the twisted yarn; means for accumulating the twisted yarn; and means for heat-setting the twisted yarn to form a heat set twisted yarn, wherein when the operation of the means for high-speed twisting system is stopped, the operation of the means for heat-setting system continues uninterrupted.

BRIEF DESCRIPTION OF THE DRAWINGS

The disclosure can be better understood with reference to the following drawings. The components in the drawings are not necessarily to scale, emphasis instead being placed upon clearly illustrating the principles of the present disclosure.

DETAILED DESCRIPTION

Figure 1:
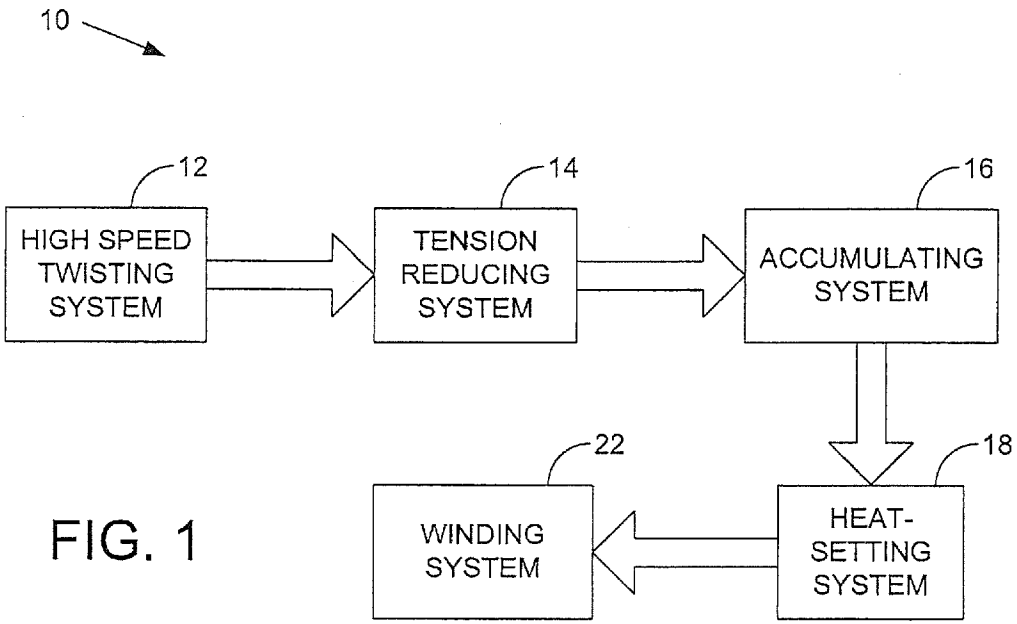
FIG. 1 illustrates an embodiment of a close-couple twisting and heat-setting apparatus.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of fibers, yarns, textiles, processes with making yarn, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

DEFINITIONS

As used herein, the term "fiber" refers to filamentous material that can be used in fabric and yarn as well as textile fabrication. One or more fibers can be used to produce a fabric or yarn. The yarn can be fully drawn or textured according to methods described herein.

As used herein, the term "cable" or "cabling" refers to twisting together two or more yarns.

As used herein, the term "cabled yarn" refers to two or more yarns twisted together.

As used herein, the term "conventional twister" refers to a system of producing a yarn by twisting together two or more single yarns simultaneously.

As used herein, the term "folded yarn" or "plied yarn" is a yarn in which two or more single yarns are twisted together in one operation (e.g., two-folded yarn (two-ply yarn), three-fold yarn (three ply yarn), and the like).

Discussion

Embodiments of the present disclosure provide for close-couple twisting and heat-setting apparatus and systems, methods of twisting yarn and heat-setting twisted yarn, and the like. Embodiments of the present disclosure provide for the coupling of two previously un-coupled apparatus. As noted above, the prior art uses two distinct and separate systems for twisting yarn and heat-setting twisted yarn (e.g., bulk continuous fiber (BCF)). The prior art apparatus and methods involve winding the twisted yarn from the twisting system on a tube after the yarn is twisted, transporting the tube of twisted yarn to a separate location in the plant, and creeling the tube of twisted yarn so that it can be introduced to the heat-setting apparatus. The prior art apparatus and systems is not coupled because the twist rate of the twisted yarn is significantly slower than the heat-set rate of the twisted yarn, and thus, are not compatible for coupling from an economic standpoint.

In contrast, embodiments of the present disclosure do not include the winding of the twisted yarn on a tube after the yarn is twisted, transporting the tube of twisted yarn to a separate location in the plant, and creeling the tube of twisted yarn so that it can be introduced to the heat-setting apparatus, because the twisting apparatus and the heat-setting apparatus can be coupled for at least the reason that the twisting apparatus is a high-speed twisting apparatus (e.g., twisting rates of greater than 10,000 rpm). By removing the steps noted above, embodiments of the present disclosure can be less expensive in terms of saving time to form the heat-set yarn, reducing personnel needed to transport the tubes and operate the equipment, reducing the square footage used due to the fewer twisting spindles/buckets required and also the close-coupled aspect of the apparatus, reduced production costs on a per weight basis, and the like. In addition, the quality and characteristics of the yarn remains substantially the same, and in some respects the quality and characteristics may be improved.

FIG. 1 is a block diagram that illustrates an embodiment of the close-couple twisting and heat-setting apparatus 10. The close-couple twisting and heat-setting apparatus 10 includes a high-speed twisting system 12, tension reducing system 14, an accumulating system 16, and a heat-setting system 18. In an embodiment, the close-couple twisting and heat-setting apparatus 10 can include a winding system 22. The high-speed twisting system 12 produces a twisted yarn. The tension reducing system 14 is interfaced with the high-speed twisting system 12. The twisted yarn from the high-speed twisting system 12 is directed onto the tension reducing system 14 to reduce the tension in the twisted yarn. The accumulating system 16 is interfaced with the tension reducing system 14. The accumulating system 16 accumulates the twisted yarn from the tension reducing system 14. The heat-setting system 18 is interfaced with the accumulating system 16. The twisted yarn from the accumulating system 16 is directed into the heat-setting system 18, where the twisted yarn is heat-set to form a heat-set twisted yarn. In an embodiment, the heat-set twisted yarn is directed to a winding system 22, where the heat-set twisted yarn is wound onto a tub.

In an embodiment, the tension-reducing system and the accumulating system form an integrated tension-reducing and accumulating system.

Embodiments of the close-couple twisting and heat-setting apparatus operate 10 in a continuous manner. In other words, at least two yarns are twisted together, and then the twisted yarn is directed to the tension reducing system 14. The twisted yarn is directed from the tension reducing system 14 to the accumulating system 16. From the accumulating system 16, the twisted yarn is directed to the heat-setting system 18. In an embodiment, the heat-set twisted yarn from the heat-setting system 18 is directed to the winding system 22. This process can continue until the yarns in the high speed twisting system 10 need to be doffed. However, when the operation of the high-speed twisting system 10 is stopped for doffing, the operation of the heat-setting system 18 continues uninterrupted. As a result, embodiments of the present disclosure provide significant advantages over the prior art, some of the advantages are noted above. Another advantage relates to the elimination of marks made by a prior art system when the fiber sits on a stationary belt in the heat-setting system 18 while the heat-set tunnel is heated.

In an embodiment, the accumulating system is sized so that it provides a predetermined period of uninterrupted operation after the operation of the high-speed twisting system is stopped. In particular, the accumulating system is sized so that it provides about 0.5 and 20 minutes of un-interrupted operation after the operation of the high-speed twisting system is stopped.

Figure 2:
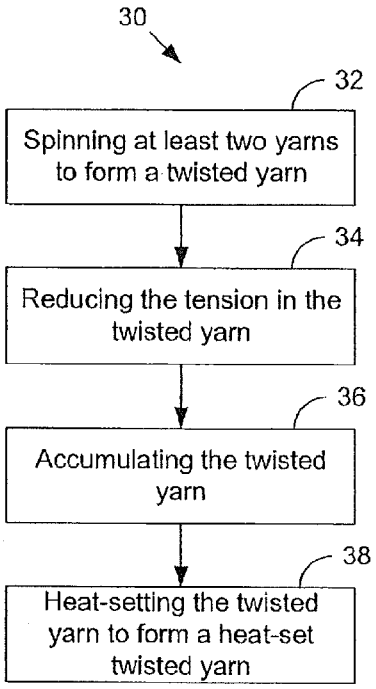
FIG. 2 is flow chart of an embodiment of a method of twisting and heat-setting yarn.

FIG. 2 is a flow chart of an illustrative embodiment of a method of twisting and heat-setting yarn 30. In block 32, at least two yarns are spun together to form a twisted yarn. In block 34, the tension from the twisted yarn is reduced. In block 36, the twisted yarn is accumulated. In block 38, the twisted yarn is heat-set to form heat set twisted yarn. When the twisting or cabling of the yarn is stopped, the heat-setting of the twisted yarn continues uninterrupted.

Figure 3:
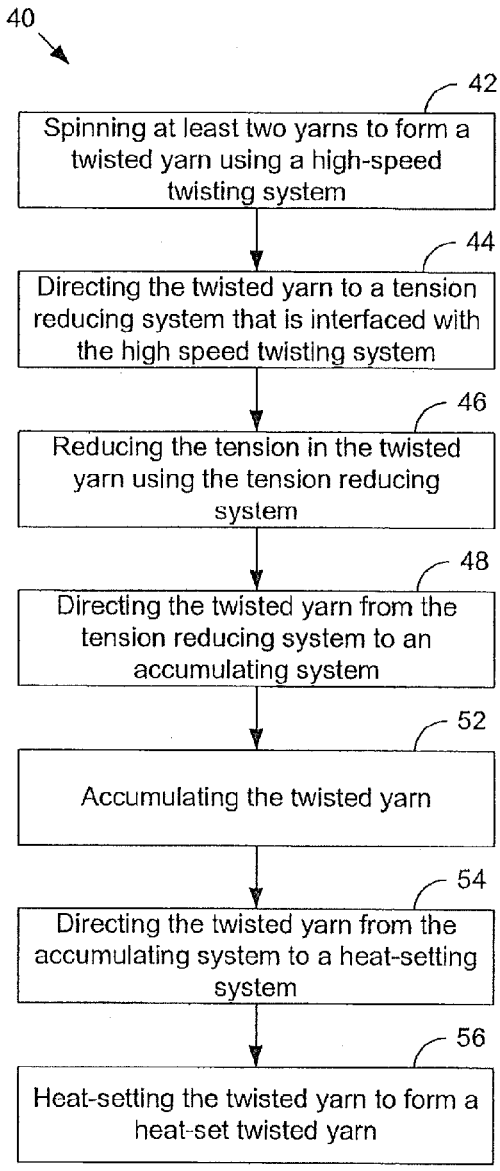
FIG. 3 is flow chart of another embodiment of a method of twisting and heat-setting yarn.

FIG. 3 is a flow chart of an illustrative embodiment of a method of twisting and heat-setting yarn 40 using embodiments of the close-couple twisting and heat-setting apparatus operate 10. In block 42, at least two yarns are twisted to form a twisted yarn using a high-speed twisting system. In block 44, the twisted yarn directed to a tension reducing system that is interfaced with the high speed twisting system. In block 46, the tension in the twisted yarn is reduced using the tension reducing system. In block 48, the twisted yarn is directed from the tension reducing system to an accumulating system. In block 52, the twisted yarn is accumulated. In block 54, the twisted yarn is directed from the accumulating system to a heat-set system. In block 56, the twisted yarn is heat-set to form a heat-set twisted yarn. When the high-speed twisting system is doffed, the heat-set system continues to operate uninterrupted.

In general, embodiments of the present disclosure use two or more bulk continuous fibers or synthetic yarns (e.g., nylon, or other polyamides, polyester and polypropylene) to create a plied yarn (two-ply, three-ply, or more) that can be used in textiles such as rugs, carpets, and the like.

Embodiments of the high speed yarn twisting or cabling apparatus relate to cabling or twisting two or more yarns together to form a single plied yarn having about 1 to 10 twists per inch (TPI) or increments therein. Embodiments of the present disclosure provide for an apparatus that can operate at unusually high speeds (about 400 to 500% faster and even about 1000% faster than current technologies) without deterioration of either process continuity or the properties (including crimp and bulk) of the plied yarn, as well as use a multi-package bucket (mentioned below) to reduce how often doffing is performed relative to a single tube bucket (single full size tube). In particular, the twisting speed is at least 2-3 times more productive than processes previously used. Additional details regarding high speed twisting systems is described below.

Once the twisted yarn is produced by the high-speed twisting apparatus, the twisted yarn is directed to the tension reducing system. The tension reducing system functions to reduce the tension on the twisted yarn prior to being directed to the accumulating system. The tension reducing system can include, but is not limited to, an overfeed device, coiler or accumulator, and combinations thereof. An overfeed device uses a combination of motorized rollers to pull or "overfeed" yarn through to an inline apparatus, which may include a winder, coiler head, accumulator, and the like. A purpose of the tension reducing device is to allow the rest of the process to run smoothly and also to allow the cabled yarn to relax so as not to pull or stretch the yarn causing deleterious effects such as crimp or bulk removal.

The twisted yarn is directed from the tension reducing system to the accumulator system. The accumulator system can include an accumulator device. The accumulator devices can include a belt, mast, drum or other such accumulator and combinations thereof. The accumulator device can be used in textile operations to interface between the pieces of equipment. In particular, the accumulator device (in combination with or including a tension reducing system) is an interface between the high speed twisting system and the heat-setting system. The twisted yarn is wound around or laid onto a portion of the accumulator device, and is subsequently directed to the heat-setting system. In an embodiment, the accumulator device can include a commercially available accumulator device from Belmont Textile Machinery Company, Belmont, N.C.

The accumulator device is useful in increasing the efficiency of the close couple twist and heat-set system by limiting the time for which yarn is not moving through the heat-set apparatus. If a large number of yarn ends are moving as a group through a heat-set apparatus and stopping one of those ends in order to bucket doff requires the stoppage of many or all of the other ends, then it is advantageous to incorporate a break in the system that can be provided by the accumulator. The accumulation of yarn allows for the entire mass of yarns to continue moving through the system despite the need to bucket doff one or a few of the yarn ends.

The twisted yarn is directed from the accumulator system to the heat-setting system. The heat-setting system functions to develop crimp and locks the twist memory in the twisted yarns. The development of crimp and twist memory have a significant impact on yarn bulk and newness retention of finished carpets. The heat-setting system includes, but is not limited to, pressurized steam heat-setting systems, hot atmospheric air heat-setting systems, infrared heat-setting systems, microwave heat-setting systems, and the like.

In an embodiment, the pressurized steam heat-setting system uses pressurized steam (i.e., saturated or near saturated steam). The most common pressurized steam heat-setting machine in the background art is referred to as a Superba® machine and is made by Superba of Mulhouse, France or American Superba, Inc. of Charlotte, N.C. An exemplary Superba heat-setting machine is model number TVP-12-806, which operates with a maximum temperature of 154° C. and typically in the temperature range from 120° C. to 140° C.; and operates with a maximum pressure of 65.26 psi and typical in the pressure range from 22 to 37 psi.

In another embodiment, the hot atmospheric air heat-setting system uses hot atmospheric air. The most common hot atmospheric air heat-setting machine in the background art is referred to as a "Suessen" machine and is made by American Suessen, Inc. of Charlotte, N.C. An exemplary Suessen heat setting machine is the Horauf-Suessen, model number GKK-6R, which typically operates in the temperature range of 160° C. to 210° C.

The crystalline structure of heat-set yarns and the end use performance of the finished carpets produced from heat-set yarns primarily depend on the heat-setting method used in producing the yarn. In general, carpet yarns produced by hot atmospheric air heat-setting machines (e.g., Seussen) have higher bulk and better stain resistance than carpet yarns produced by pressurized steam heat-setting machines (e.g., Superba®).

Once the twisted yarns are heat-set by the heat-setting system, the heat set twisted yarn can be wound using a winding system. The winding system is a standard piece of equipment commercially available for use in textile operations. The winding system may include an overfeed system to reduce tension on the final yarn package, cams that engage the tube core in order to rotate it during winding, a number of guides to determine the path of the yarn, and a doffing system in order to remove the full yarn packages. The winder pulls the heat set twisted yarn from the heat-setting system and winds it onto an appropriately sized tube. A suitable winder is available from Belmont Textile Machinery Company, Belmont, N.C. or American Superba, Inc. of Charlotte, N.C.

Additional processes that can be performed on the heat-set twisted yarn can include packaging, tufting, dyeing, and finishing.

In an embodiment, the twisting system includes a multi-package bucket that can include 2, 3, 4, or more full sized (11 inches) tubes (e.g., yarn tube or yarn package). The yarns of each of the tubes are tied to one another to form a continuous yarn. In an embodiment having two tubes (a double-bucket), the end of the yarn of the first tube or top tube is tied to the start of the second tube or bottom tube so that once the first tube is completely unwound, the yarn of the second tube is taken up.

Each additional tube can increase the time between each doff cycle by a factor relative to a bucket including a single full size tube, where the factor can be determined using the following formula: $((A\times2)-1)$, where A is the number of tubes. For example, if the multi-package bucket is a double-bucket that includes two full size tubes, then the factor is 3, so that the time between doff cycles increases by a factor of three relative to a bucket including a single full size tube. Thus, increasing the time between doffing increases the production efficiency of embodiments of the present disclosure. Additional details are described in Appendix A.

An embodiment of a high speed yarn twisting or cabling apparatus is described in Attachment A.

As noted above, the yarn can include a polymer fiber. The polymer fiber can include fibers such as, but not limited to, a polyamide fiber, polyester fiber, polypropylene fiber, and the like. In particular, the polymer fiber can be a polyamide fiber. The term "polyamide" as used herein means the well-known fiber-forming substance that is a long-chain synthetic polyamide. The polyamides can be a homopolymer, copolymer, or terpolymer, or mixtures of polymers. Embodiments of polyamide fibers include, but are not limited to, polyhexamethylene adipamide (nylon 6,6); polycaproamide (nylon 6); polyenanthamide (nylon 7); poly(10-aminodecanoic acid) (nylon 10); polydodecanolactam (nylon 12); polytetramethylene adipamide (nylon 4,6); polyhexamethylene sebacamide homopolymer (nylon 6,10); a polyamide of n-dodecanedioic acid and hexamethylenediamine homopolymer (nylon 6,12); and a polyamide of dodecamethylenediamine and n-dodecanedioic acid (nylon 12,12). In addition, the polyamide can be a copolymer polyamide (e.g., a polyamide polymer derived from two or more dissimilar monomers). In particular, the polyamide fiber is polyhexamethylene adipamide and copolymers thereof. The copolymer may contain a variety of comonomers known in the art, and in particular, may contain methylpentamethylene diamine and isophthalic acid. The polymer or copolymer can also include a variety of additives such as delusterants, pigments, stabilizers, antistatic agents, and the like.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

A device was set up such that a single end from a high speed twister could be run concurrently with conventionally twisted yarn through a Superba™ heat set tunnel. The resulting yarns (both standard and coupled high speed twist yarn) were analyzed for various properties.

A nylon 6,6 creel yarn having a denier of 2615 and a nylon 6,6 bucket yarn having a denier of 2615 were twisted at a rate of 19,300 rpm (twisting speed) with the take-up speed set so that a twist level of 3 TPI was obtained. The high speed twisted yarn was drawn from the twister using an overfeed present on the Superba™ heat-set tunnel positioned before the coiler. Both the high speed twisted yarn (coupled to the heat-set tunnel) and the standard twisted yarn (from the creel) were simultaneously fed through the heat-set tunnel to show any differences in the two twisting and heat-set processes. Filament form analysis was performed in order to determine the changes, if any, in the amount or type of crimp in the traditionally twisted and the coupled high speed twisted yarn. The conventionally twisted and heat-set yarn had a crimp value of 54 with a standard deviation of 3 and the high speed twisted yarn coupled to the heat-set tunnel had a crimp value of 55 with a standard deviation of 5 indicating that there was no change in number of crimps due to coupling of the high speed twister to the heat-set tunnel.

Yarns were also produced in a similar fashion with multiple standard twisted ends running side by side with the single high speed twisted yarn coupled to the heat-set system with different deniers were tufted into multiple carpet constructions. No deleterious effects due to processing with the close-coupled system were observed in the carpet properties. In fact, two ends of the high speed twisted yarn could generally be tufted in a carpet primarily made of standard yarn with no visual way of detection. The same was done and held true with standard yarn in a high speed twisted carpet.

Some of the constructions along with the speeds of the high speed coupled twist and heat-set process are listed below. All were compared to standard processed yarns with twisting speeds between 5500 and 7000 rpm.

TABLE 1

| Test Item | Denier | TPI | Guage | Stitches/ inch | Pile Height | Cut/ Loop | RPM |
|---|---|---|---|---|---|---|---|
| 1 | 2615 | 3 | 5/32 | 7 | 3/16 | Loop | 22050 |
| 2 | 1760 | 3 | 1/10 | 10 | 1/4 | Loop | 18500 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'". The term "consisting essentially of" is defined to include a formulation that includes the inks or dyes specifically mentioned as well as other components (e.g., solvents, salts, buffers, biocides, binders, an aqueous solution) using in an ink formulation, while not including other dyes or inks not specifically mentioned in the formulation.

Many variations and modifications may be made to the above-described embodiments. All such modifications and variations are intended to be included herein within the scope of this disclosure and protected by the following claims.

At least the following is claimed:

1. A close-couple twisting and heat-setting apparatus comprising:

a high-speed twisting system for producing a twisted yarn;

a tension reducing system interlaced with the high-speed twisting system, wherein the twisted yarn is directed onto the tension reducing system from the high-speed twisting system to reduce the tension in the twisted yarn;

an accumulating system interfaced with the tension reducing system, wherein the twisted yarn from the tension reducing system is accumulated; and a heat-setting system interfaced with the accumulating system, wherein the twisted yarn from the accumulating system is heat-set to form a heat set twisted yarn, wherein when the operation of the high-speed twisting system is stopped, the operation of the heat-setting system continues uninterrupted; and wherein the high-speed twisting system has a twisting speed of about 10,000 to 100,000 rpm.

2. The close-couple twisting and heat setting apparatus of claim 1, wherein the tension-reducing system and the accumulating system comprise an integrated tension-reducing and accumulating system.

3. The close-couple twisting and heat setting apparatus of claim 1, wherein the accumulating system is sized so that it provides a predetermined period of uninterrupted operation after the operation of the high-speed twisting system is stopped.

4. The close-couple twisting and heat setting apparatus of claim 3, wherein the accumulating system is sized so that it provides about 0.5 and 20 minutes of un-interrupted operation after the operation of the high-speed twisting system is stopped.

5. The close-couple twisting and heat setting apparatus of claim 1, further comprising: a winding system interfaced with the heat-setting system, wherein the winding system winds the heat-set twisted yarn.

6. The close-couple twisting and heat setting apparatus of claim 1, wherein the tension reducing system includes an overfeed system.

7. The close-couple twisting and heat setting apparatus of claim 1, wherein the heat-setting system includes a coiler and a heat-set tunnel.

8. The close-couple twisting and heat setting apparatus of claim 1, wherein the heat-setting system is adapted to heat-set the twisted yarn when the high-speed twisting system is being doffed.

9. A method of twisting yarn and heat-setting twisted yarn, comprising:

twisting or cabling at least two yarns to form a twisted yarn using a high-speed twisting system;

directing the twisted yarn to a tension reducing system that is interfaced with the high speed twisting system;

reducing the tension in the twisted yarn using the tension reducing system;

directing the twisted yarn from the tension reducing system to an accumulating system;

accumulating the twisted yarn;

directing the twisted yarn from the accumulating system to a heat-set system; and heat-setting the twisted yarn to form a heat-set twisted yarn, wherein twisting or cabling at least two yarns includes: twisting or cabling the at least two yarns at about 10,000 to 100,000 rpm.

10. The method of claim 9, further comprising: winding the heat-set twisted yarn.

11. The method of claim 9, wherein when twisting or cabling at least two yarn is stopped, the heat-setting of the twisted yarn continues uninterrupted.

12. The method of claim 9, wherein the tension-reducing system and the accumulating system comprise an integrated tension-reducing and accumulating system.

13. The method of claim 9, wherein the accumulating system is sized so that it provides a predetermined period of uninterrupted operation after the operation of the high-speed twisting system is stopped.

14. The method of claim 13, wherein the accumulating system is sized so that it provides about 0.5 and 20 minutes of un-interrupted operation after the operation of the high-speed twisting system is stopped.

15. A method of twisting yarn and heat-setting twisted yarn, comprising:

twisting or cabling at least two yarns to form a twisted yarn;

reducing the tension in the twisted yarn;

accumulating the twisted yarn; and heat-setting the twisted yarn to form a heat set twisted yarn, wherein when twisting or cabling at least two yarn is stopped, the heat-setting of the twisted yarn continues uninterrupted and wherein the high-speed twisting system has a twisting speed of about 10,000 to 100,000 rpm.

16. An apparatus for twisting yarn and heat-setting twisted yarn, comprising:

means for spinning at least two yarns to form a twisted yarn at a twisting speed of about 10,000 to 100,000 rpm;

means for reducing the tension in the twisted yarn;

means for accumulating the twisted yarn; and means for heat-setting the twisted yarn to form a heat set twisted yarn, wherein when the operation of the means for high-speed twisting system is stopped, the operation of the means for heat-setting system continues uninterrupted.

* * * * *